US005709489A

United States Patent [19]

Ambrose

[11] Patent Number: 5,709,489

[45] **Date of Patent: *Jan. 20, 1998**

[54] KEYBOARD POSITIONING SYSTEM

[76] Inventor: Frederic C. Ambrose, 142 The Channel, Brewster, Mass. 02631

[ * ] Notice: The term of this patent shall not extend beyond the expiration date of Pat. No. 5,567,067.

[21] Appl. No.: 734,755

[22] Filed: Oct. 21, 1996

Related U.S. Application Data

[63] Continuation of Ser. No. 511,535, Aug. 4, 1995, Pat. No. 5,567,067, which is a continuation of Ser. No. 303,582, Sep. 9, 1994, abandoned, which is a continuation of Ser. No. 60,720, May 10, 1993, abandoned, which is a continuation of Ser. No. 982,879, Nov. 30, 1992, abandoned, which is a continuation of Ser. No. 910,667, Jul. 8, 1992, abandoned, which is a continuation of Ser. No. 648,628, Feb. 1, 1991, abandoned.

[51] Int. Cl.[6] ..... B41J 5/08

[52] U.S. Cl. ..... 400/472; 400/715; 248/118.1

[58] Field of Search ..... 400/472, 473, 400/480, 481, 489, 488, 681, 715; 248/118, 118.1–118.5, 918; 235/146, 145 A, 145 R; 312/208.1, 208.4

[56] References Cited

U.S. PATENT DOCUMENTS

| | | | |
|---|---|---|---|
| 293,971 | 2/1884 | Lyford | 38/107 |
| 1,189,529 | 7/1916 | Benson | 38/106 |
| 1,277,169 | 8/1918 | Anderson | 248/118.3 |
| 3,830,352 | 8/1974 | Kolpek | 400/681 |
| 3,902,034 | 8/1975 | Isozaki | 200/239 |

(List continued on next page.)

FOREIGN PATENT DOCUMENTS 2910855 2/1980 Germany .

OTHER PUBLICATIONS

Stack, B., "Keyboard RSI: The Pratical Solution" Publication Date Unknown. pp. 29–37.

Stack, B., "Repetitive Strain Injury–Prevention and Rehabilitation," First International Congress on Ergonomics, Occupational Health and Safety and the Environment.

Patkin, M., Neck and Arm Pain in Office Workers: Causes and Management, reproduced in "Promoting health productivity in the computerized office: Models of successful ergonomic interventions", Chapter 13, (Taylor & Francis, New York) pp. 207–231, 1990.

Hedge et al, "An Experimental test of a Design Prototype Of The Protex System", pp. 7–12, Dec. 1, 1991.

IBM Technical Disclosure Bulletin, vol. 27 No. 1A, Jun. 1984, "Adjustable Keyboard", E. H. Frank, pp. 153–154.

IBM Technical Disclosure Bulletin, vol. 28 No. 1, Jul. 1985, "Adjustable Terminal Table", Author Unknown, pp. 747–750.

Tiffany Office Furniture Catalog, pp. 13–16 & 30. 1990.

Steelcase Product Review, Oct. 27, 1986.

*Primary Examiner*—Edgar S. Burr
*Assistant Examiner*—Anthony H. Nguyen
*Attorney, Agent, or Firm*—Testa, Hurwitz & Thibeault, LLP

[57] ABSTRACT

The present invention is a device for mounting a keyboard to a base and for positioning the keyboard in a backward tilted position and for use by an operator having at least one hand. The keyboard has a plurality of keys, a front end, a rear end, and a top surface or key plane defined by a plane of the uppermost portion of the keys. In one embodiment, the device comprises a bracket engaged to the base and a clamp engaged with the bracket such that the keyboard may be orientated in a backward tilted position which is defined by the rear end of the keyboard being disposed below the front end of the keyboard. The clamp is engagable with the keyboard to prevent the keyboard from falling off when the keyboard is orientated in said backward tilted position. The clamp may comprise first and second clamp members. The device further comprise a hand support member engaged with the clamp to a position above the key plane of the keyboard when the keyboard is orientated in said backward tilted position and is adapted to support the hand of the operator.

11 Claims, 4 Drawing Sheets

U.S. PATENT DOCUMENTS

| | | | |
|---|---|---|---|
| 4,307,672 | 12/1981 | Shikimi | 108/139 |
| 4,481,556 | 11/1984 | Berke et al. | 400/715 |
| 4,515,086 | 5/1985 | Kwiecinski et al. | 108/96 |
| 4,545,544 | 10/1985 | Latino et al. | 248/118.1 |
| 4,616,798 | 10/1986 | Smeenge et al. | 248/281.1 |
| 4,632,349 | 12/1986 | Ansley | 248/281.1 |
| 4,664,875 | 5/1987 | Watt | 108/143 |
| 4,688,862 | 8/1987 | Fowler et al. | 400/715 |
| 4,709,972 | 12/1987 | LaBudde et al. | 312/208 |
| 4,736,689 | 4/1988 | Stanko | 108/5 |
| 4,779,922 | 10/1988 | Cooper | 297/188 |
| 4,826,123 | 5/1989 | Hannah et al. | 248/248 |
| 4,852,500 | 8/1989 | Ryburg et al. | 108/105 |
| 4,913,390 | 4/1990 | Berke | 248/118.5 |
| 4,923,259 | 5/1990 | Bartok | 312/208 |
| 4,976,407 | 12/1990 | Schwartz et al. | 348/118.3 |
| 5,005,669 | 4/1991 | Umebara | 186/61 |
| 5,016,367 | 5/1991 | Breen | 38/135 |
| 5,037,054 | 8/1991 | McConnell | 248/284 |
| 5,040,757 | 8/1991 | Benaway | 248/118.3 |
| 5,041,770 | 8/1991 | Seiler et al. | 318/265 |
| 5,048,784 | 9/1991 | Schwartz et al. | 248/244 |
| 5,119,742 | 6/1992 | Simmie | 108/152 |
| 5,154,390 | 10/1992 | Bain et al. | 248/447.2 |
| 5,183,230 | 2/1993 | Walker | 248/118 |
| 5,205,631 | 4/1993 | Wegman et al. | 312/348.3 |
| 5,242,139 | 9/1993 | Aldrich | 248/118 |
| 5,273,250 | 12/1993 | Pemberton et al. | 248/918 |
| 5,320,313 | 6/1994 | Crowe | 248/231.6 |
| 5,351,897 | 10/1994 | Martin | 248/118 |
| 5,357,873 | 10/1994 | Hilton | 108/50 |
| 5,374,018 | 12/1994 | Daneshvar | 248/118 |

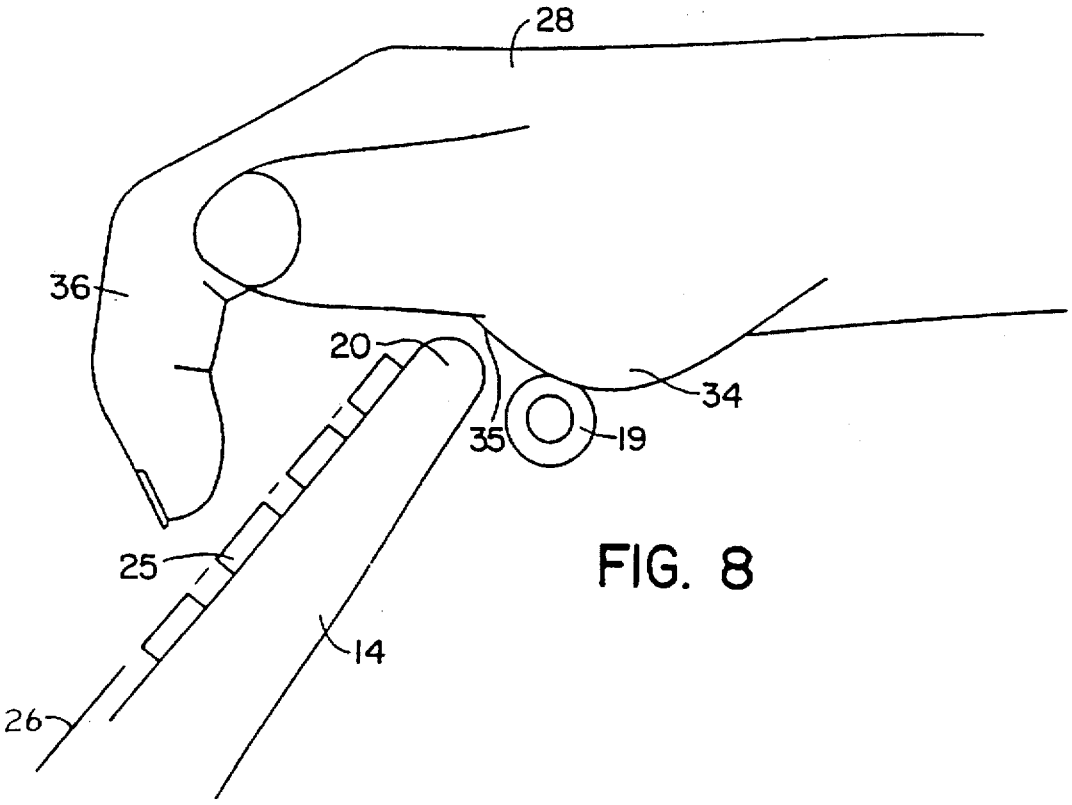
FIG. 8
FIG. 9
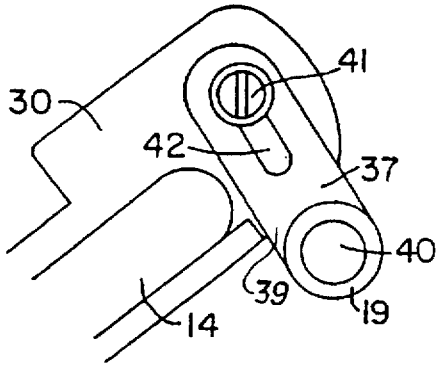
FIG. 10
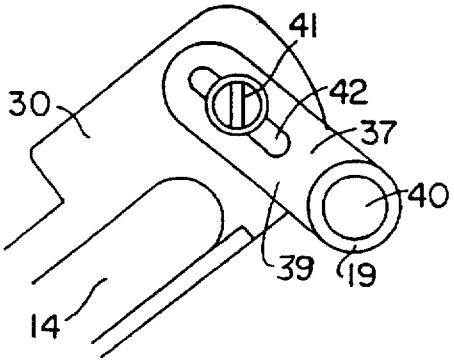

KEYBOARD POSITIONING SYSTEM

This application is a continuation of application Ser. No. 08/511,535 filed on Aug. 4, 1995, now U.S. Pat. No. 5,567,067, which is a continuation of application Ser. No. 08/303,582 filed on Sep. 9, 1994 now abandoned, which is a continuation of application Ser. No. 08/060,720 filed on May 10, 1993 now abandoned, which is a continuation of application Ser. No. 07/982,879 filed on Nov. 30, 1992 now abandoned, which is a continuation of application Ser. No. 07/910,667 filed on Jul. 8, 1992 now abandoned, which is a continuation of application Ser. No. 07/648,628 filed on Feb. 1, 1991 now abandoned.

FIELD OF THE INVENTION

The present invention relates to devices for positioning a computer keyboard relative to a work surface such as a desk.

BACKGROUND OF THE INVENTION

In the design of alphanumeric keyboards for use in typewriters, computers, typesetters, and certain scientific and technical instruments, it has been generally assumed that the keyboard must be tilted forward, that is, the front or operator edge of the keyboard surface must be lower than the rear edge of the keyboard surface. It will be recognized that the word keyboard in this patent application will generally be used to apply to the above types of keyboards as opposed to the keyboards found in musical instruments. The assumption that this orientation is the proper way to design a keyboard may have many origins. Certainly, from the point of view of mechanical orientation of the mechanical links found in early keyboard systems, this arrangement was probably necessary. Furthermore, for operators who are not "touch" typists, it was generally necessary and desirable that the keys be arranged in such a way that their identity, designated by symbols on the keys, could be easily visible to the operator by tipping the surface of the keyboard toward the operator. Furthermore, a somewhat mechanistic concept of how the human hand operates might well suggest that the forward tipping of the keyboard would be the most efficient way of positioning the keyboard before the operator. For these and other reasons, the forward tipping of the keyboard plane is essentially universal. Such a typical orientation is shown in FIG. 1 of the drawings.

In a separate development, the medical community has become increasingly aware of an extreme irritating, but non-lethal physical affliction, known generally as "carpal tunnel" syndrome. In this affliction, the median nerve, which extends down the arm and out to the human hand, can be damaged at the point at which it passes through the human wrist joint. The occurrence of this affliction has a large number of unpleasant physical consequences. Generally, the affliction is associated with situations in which the hand and wrist are bent upward and backward and, while in that position, significant weight is applied to the wrist. This phenomenon which is very common among serious bicycle riders can result in long term pain and disability.

It has been observed that the carpal tunnel syndrome is frequently associated with persons who are professional keyboard operators. It appears that the forward tilt of the keyboard, which is universally accepted as the proper design for a keyboard, may well force the operator, on a long term and continuous basis, to arch back the hand and wrist in such a way that, over the many years that the operator may be sitting before the keyboard, permanent work place injury could result. This unfortunate circumstance may well be resulting in serious long term human suffering and, of course, the financial liabilities and difficulties which can be associated with such human suffering. This problem is compounded by another aspect of conventional keyboard design. Ordinarily, the operator is required to sit before the keyboard with hands extended over the keyboard. Holding the hands over the keyboard for hours at a time places tremendous stress on the operator's shoulder and neck muscles. In conventional mechanical typewriters, this uncomfortable and potentially harmful condition was constantly relieved by the peripheral activities required by the mechanical typewriter; i.e., hitting the carriage return bar and changing sheets of paper. With modern word processing systems, the operator can literally spend hours without removing his or her hands from the keyboard. The long term effect of holding one's hands over the keyboard, day after day, year after year, may well cause harmful neck and shoulder muscles stress. These and other difficulties, experienced with the prior art devices, have been obviated in a novel manner by the present invention.

A first object of the invention is to provide a keyboard positioning system in which the keyboard is tipped backward so that the operator's hands and wrist assume a position which does not cause irritation or damage to nerves which pass through the wrist joint.

Another object of the present invention is to provide a keyboard positioning system which holds the keyboard in a position in which it is tipped backwards in order to provide a more comfortable and restful orientation for professional or long term keyboard operators.

Another object of the present invention is to provide a keyboard positioning system which supports the operator's hands in a proper position over the keyboard in order to minimize neck and shoulder muscle strain.

SUMMARY OF THE PRESENT INVENTION

The present invention is a device for mounting a keyboard to a base and for positioning the keyboard in a backward tilted position and for use by an operator having at least one hand. The keyboard has a plurality of keys, a front end, a rear end, and a top surface or key plane defined by a plane of the uppermost portion of the keys. In one embodiment, the device comprises a bracket engaged to the base and a clamp engaged with the bracket such that the keyboard may be orientated in a backward tilted position which is defined by the rear end of the keyboard being disposed below the front end of the keyboard. The clamp is engagable with the keyboard to prevent the keyboard from falling off when the keyboard is orientated in said backward tilted position. The clamp may comprise first and second clamp members. The device further comprise a hand support member engaged with the clamp to a position above the key plane of the keyboard when the keyboard is orientated in said backward tilted position and is adapted to support the hand of the operator.

BRIEF DESCRIPTION OF THE DRAWINGS

The following detailed description of the present invention will be more fully understood with reference to the accompanying drawings in which:

FIG. 8 is a diagrammatic view of one orientation of the operator's hand; and

FIGS. 9 and 10 are detailed views of one embodiment of the hand support.

DETAILED DESCRIPTION OF THE PREFERRED EMBODIMENTS

Figure 1:
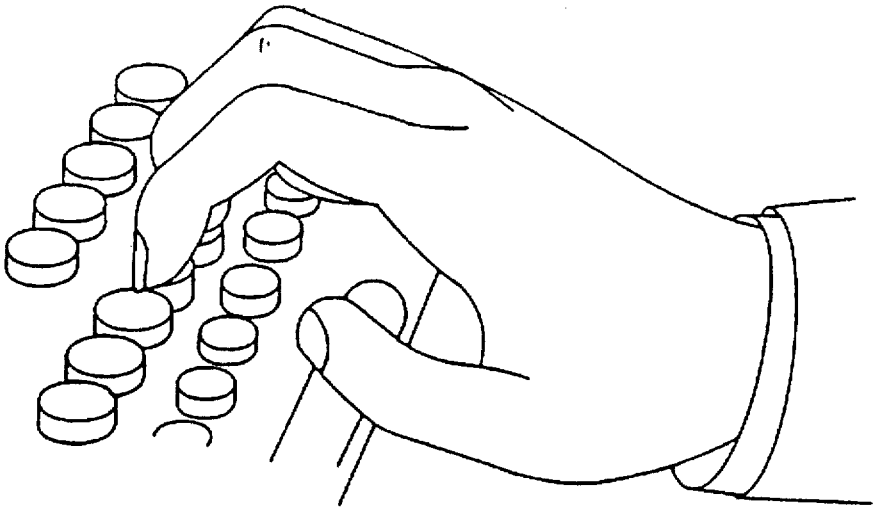
FIG. 1 is a perspective view of the prior art keyboard orientation.
Figure 2:
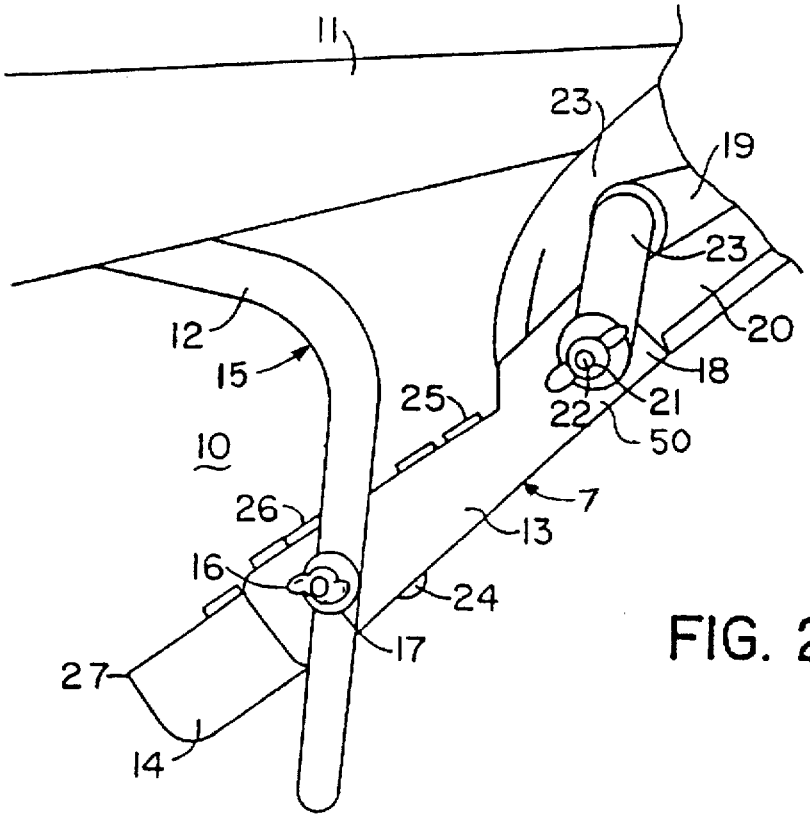
FIG. 2 is a perspective view of a first embodiment of the present invention.
Figure 3:
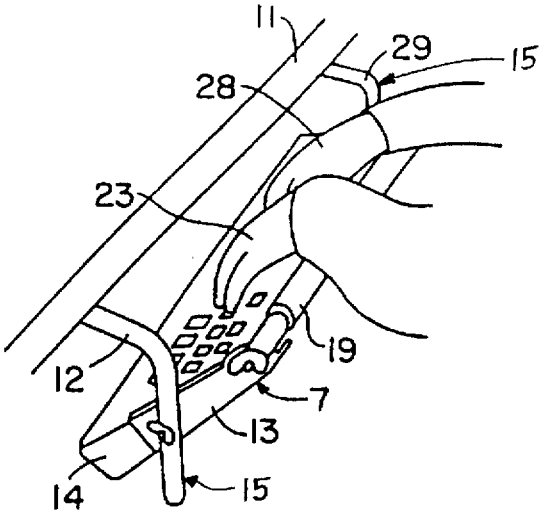
FIG. 3 is another perspective view of the first embodiment of the present invention.

Referring to FIGS. 2–8, wherein a keyboard 14 has a plurality of keys 25, a front end 20, a rear end 27, and a top surface or key plane 26 defined by a plane of the uppermost portion of the keys 25.

In one embodiment the keyboard positioning system or device 10 comprises a positioning bracket 15 connected to a base or a desk surface 11. The device 10 further comprises a clamp or support 7 which is adjustably connected to the positioning bracket 15 such that the keyboard 14 may be orientated in a backward tilted position which is defined by the rear end 27 of the keyboard 14 being disposed below the front end 20 of the keyboard 14. The clamp 7 is engagable with the keyboard 14 to prevent the keyboard 14 from falling off when the keyboard 14 is orientated in the backward tilted position. In one embodiment, the positioning bracket 15 comprises first and second bracket members 12 and 29 connected to the base 11. Each of the bracket members 12 and 29 may be constructed from a variety of materials and take a variety shapes. In the embodiment shown, bracket members 12 and 29 are in the form of an elongated substantially L-shaped arm.

Figure 4:
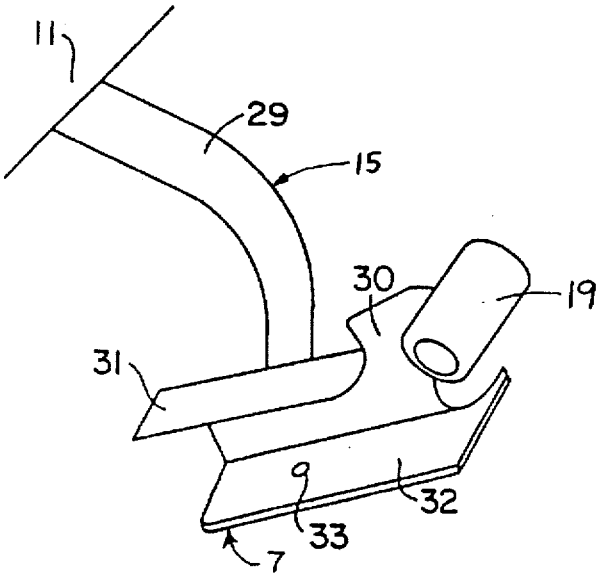
FIGS. 4 and 5 are perspective views showing one of the clamp members of the clamp and one of the bracket members of the bracket.
Figure 5:
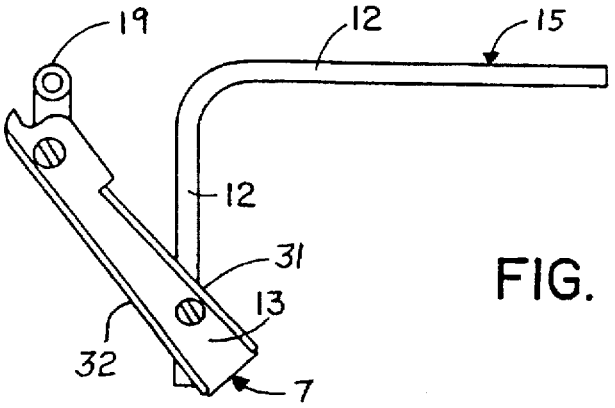
Figure 6:
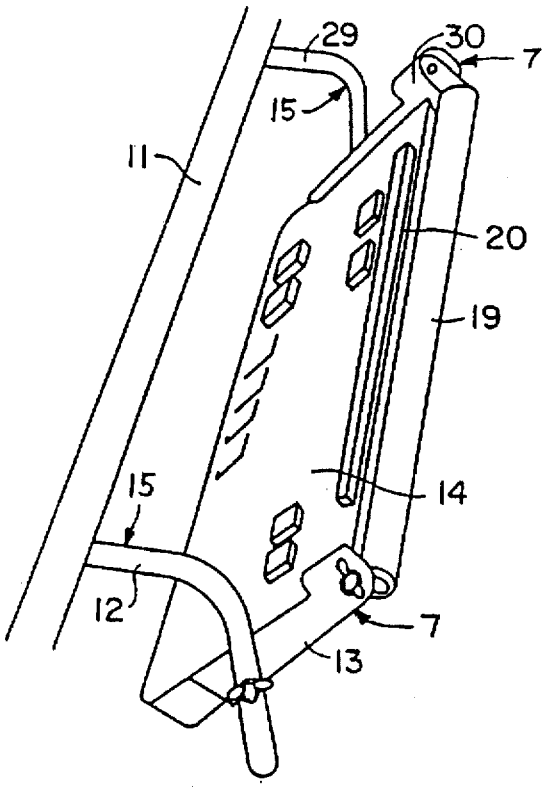
FIGS. 6 and 7 are additional perspective views of the first embodiment of the present invention.
Figure 7:
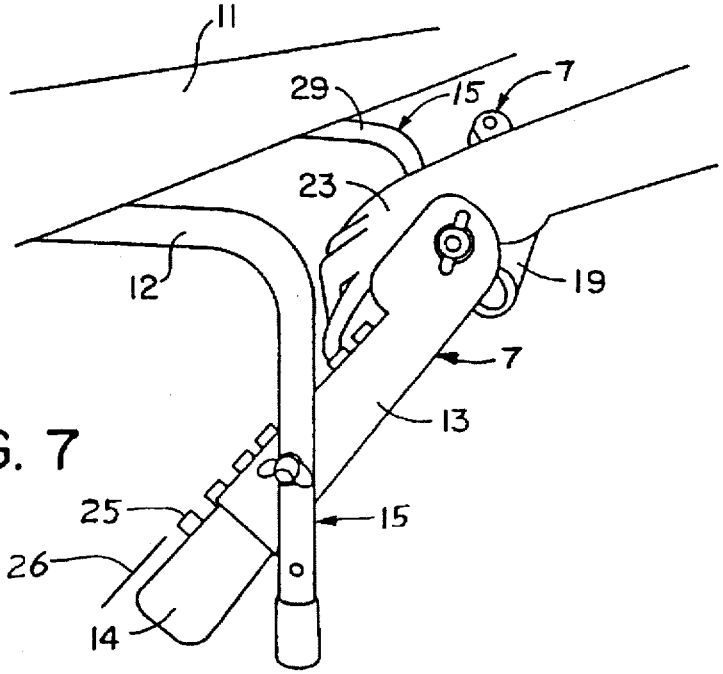

In one embodiment, the clamp 7 comprises first and second clamp members 13 and 30 which are adjustably connected to the first and second bracket members 12 and 29, respectively. The clamp members 13 and 30 are adjustably connected to the bracket members 12 and 29, respectively, by a wing nut and bolt combination 16 and 17. As best shown by FIGS. 4 and 5, each of the clamp members 13 and 30 comprise a lower support surface 32 and an upper support surface 31 which oppose one another and engage the side edge of the keyboard 14. Each of the clamp members 13 and 30 further comprise a set screw 33 to securingly engage the keyboard 14 so that it does not slide out when the keyboard 14 is in the backward tilted position. Each of the clamp members 13 and 30 may be constructed from a variety of materials and take a variety shapes. In the embodiment shown, clamp members 13 and 30 are each formed in the shape of a channel.

The device 10 further comprises a hand support 19 moveably connected to the clamp 7 (and clamp members 13 and 30) by means of a wing nut 21 and bolt 22. The hand support 19 extends across the front edge 20 of the keyboard 14 and is moveable to a variety of positions above (FIG. 2) and/or below (FIG. 7) the top surface or key plane 26 of the keyboard 14. The hands 23 of the operator extend over the hand support bar 19 and hang downwardly toward the keys 25 of the keyboard 14. As best shown by FIGS. 9 and 10, in one embodiment, the hand support 19 comprises a hand support holder 37 at each end of the hand support 19. Each of the hand support holders 37 is formed of a plate 39 and a pin 40 mounted on the plate and extending outward from the plane of the drawing. The plate 39 is adjustably mounted to the clamp members 13 and 30 by a bolt 41 which extends through a slot 42 in the plate 39 to allow both rotation and radial positioning of the pin 40. The pin 40 is shaped to engage with the end of the hand support 19. The hand support 19 is formed of a hollow cylinder which can be easily cut to length and engaged by the pin 40, on one end, and a corresponding pin on the other end. In this way, the system can be adapted to the various widths of the keyboard 14.

In the preferred embodiment, the top surface or keyboard plane 26 is backward tilted from 30 degrees to 60 degrees down from the horizontal. The invention appears to be beneficial rom 10 degrees to 70 degrees and offers some benefit from 0 degrees to 70 degrees.

FIG. 8 is a diagrammatic view of the one embodiment of the operator's hand 28, the front edge 20 of the keyboard 14 and the hand support 19. The hand support 19 engages and supports the proximal palm 34. The palm 34 curves over (without touching) the front edge 20 of the keyboard 14 and the fingers 36 reach to the keys 25.

For purposes of this application and invention, the term "neutral position" of the wrist is understood by those of ordinary skill to be that position in which the wrist is neither flexed nor extended. Those of ordinary skill in the art also recognize that keyboard keys are used with differing frequency in written language and that those of greatest frequency of use (i.e., the letter keys) are clustered together around the center of the keyboard in accordance with relative finger strength and dexterity. These are the "most used" keys. An operator's forearms usually defined a plane which, if it is not parallel with, has an intersection with that defined by the top surfaces of the keys, thereby clarifying the "key plane" and "the intersection of the key plane and the operator's arm."

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A device for mounting a keyboard to a base and for positioning the keyboard in a backward tilted position and for use by an operator having at least one hand, the keyboard having a plurality of keys, a front end, a rear end, and a key plane defined by a plane of the uppermost portion of the keys, the device comprises:

(a) a bracket engageable with a base;

(b) a clamp engaged with said bracket said clamp being engagable with a keyboard such that the keyboard may be orientated in a backward tilted position defined by the rear end of the keyboard being disposed below the front end of the keyboard, to prevent the keyboard from falling off when the keyboard is orientated in said backward tilted position; and (c) a hand support member adjustably engaged with said clamp and positionable to a position above the key plane of the keyboard when the keyboard is orientated in said backward tilted position and which is adapted to support the hand of the operator.

2. The device of claim 1, wherein said clamp is movably connected to said bracket.

3. The device of claim 1, wherein said clamp is rotatably connected to said bracket.

4. The device of claim 1, wherein said hand support is movably connected to said clamp.

5. The device of claim 1, wherein said hand support is rotatably connected to said clamp.

6. The device of claim 1, wherein said clamp comprises first and second clamp members each comprising a front portion, a rear portion, and a support surface, said first and second clamp members being adapted to engage the keyboard to prevent the keyboard from falling off when the keyboard is orientated in said backward tilted position.

7. The device of claim 6, wherein said bracket comprises first and second bracket members.

8. The device of claim 7, wherein said first clamp member is connected to said first bracket member and said second clamp member is connected to said second bracket member.

9. The device of claim 8, wherein said first clamp member is movably connected to said first bracket member and said second clamp member is movably connected to said second bracket member.

10. The device of claim 8, wherein said first clamp member is rotatably connected to said first bracket member and said second clamp member is rotatably connected to said second bracket member.

11. The device of claim 6, wherein each of said first and second clamp members comprise a set screw adapted to engage the keyboard to prevent the keyboard from falling off when the keyboard is orientated in said backward tilted position.

* * * * *